US005549225A

United States Patent [19]

Lii

[11] Patent Number: 5,549,225

[45] Date of Patent: Aug. 27, 1996

[54] ADJUSTABLE C CLAMP

[76] Inventor: Liang-Kuen Lii, 58, Ma Yuan West St., Taichung, Taiwan

[21] Appl. No.: 528,463

[22] Filed: Jul. 28, 1995

[51] Int. Cl.[6] ..... B65D 35/00

[52] U.S. Cl. ..... 222/192; 222/391; 7/170

[58] Field of Search ..... 222/191, 386, 222/391, 192; 7/167, 170; 269/329

[56] References Cited

U.S. PATENT DOCUMENTS 4,164,093 8/1979 Sterrett et al. ..... 7/170 X 4,869,403 9/1989 Bruning ..... 222/386 X

*Primary Examiner*—Gregory L. Huson

[57] ABSTRACT

An angle-adjustable C-clamp has a handle with an upper interior to receive a rod. The upper front edge of the handle has a couple of step-shaped front edges with two positioning posts extending forward from each front edge. The positioning posts are inserted in a rotary seat and a disk plate. The rotary seat has a central opening to receive the positioning posts. An upper and lower seat lugs are protruded upward and downward from the rotary seat, respectively. The disk plate which has a central square hole and four rectangular holes corresponding to the four positioning posts is disposed in the rotary seat. The C-shaped frame has a lobe at one end and a fixed jaw at the other end. The lobe connects the lower seat lug. The rod has a ball at front end. The rod passes through the central opening and the square hole. The ball is inserted in the socket of the movable jaw.

2 Claims, 5 Drawing Sheets

ADJUSTABLE C CLAMP

BACKGROUND OF THE INVENTION

The invention relates to a C-clamp. More particularly the invention relates to an adjustable C-clamp which can be converted to a glue spreading barrel.

A conventional C-clamp cannot be converted to a barrel of a glue spreading barrel. A conventional glue spreading barrel cannot be converted to a C-clamp, either. The user need a C-clamp which can be converted to a barrel of a glue spreading gun in narrow room.

SUMMARY OF THE INVENTION

An object of the invention is to provide a C-clamp which can be converted to a barrel of a glue spreading gun.

Accordingly, an angle-adjustable C-clamp comprises a handle with an upper interior to receive a rod, an upper front edge of the handle has a couple of step-shaped front edges with two positioning posts extending forward from each step-shaped front edge. The positioning posts are inserted in a rotary seat and a disk plate. The rotary seat has a central opening to receive the positioning posts. An upper and lower seat lugs are protruded upward and downward from the rotary seat, respectively. The disk plate which has a central square hole and four rectangular holes corresponding to said four positioning posts is disposed in the rotary seats. A generally C-shaped frame has a lobe at one end and a fixed jaw at the other end. The rod has a ball at front end to be inserted in a socket of a movable jaw, and the rod passes through the central opening and the square hole.

Accordingly, another example is that an angle-adjustable C-clamp comprises a handle with an upper interior to receive a rod, an upper front edge of the handle having a couple of step-shaped front edges with two positioning posts extending forward from each of the step-shaped front edge, and the positioning posts inserted in a rotary seat and a disk plate. The rotary seat has a central opening to receive the positioning posts. An upper and lower seat lugs are protruded upward and downward from the rotary seat, respectively. The disk plate which has a central square hole and four rectangular holes corresponding to the four positioning posts is disposed in the rotary seat. The rod has a ball at front end to be inserted in a socket of a movable jaw. The rod passes through the central opening and the square hole, A barrel has two barrel lugs protruded upward and downward from a rear end rim of the barrel, respectively. Each of the barrel lug has a round hole to match a corresponding through hole on the upper and lower seat lugs to be fixed by screws and nuts. A recess is formed between a rear end rim of the barrel and the barrel lug to receive the rotary seat.

DETAILED DESCRIPTION OF THE INVENTION

Figure 1:
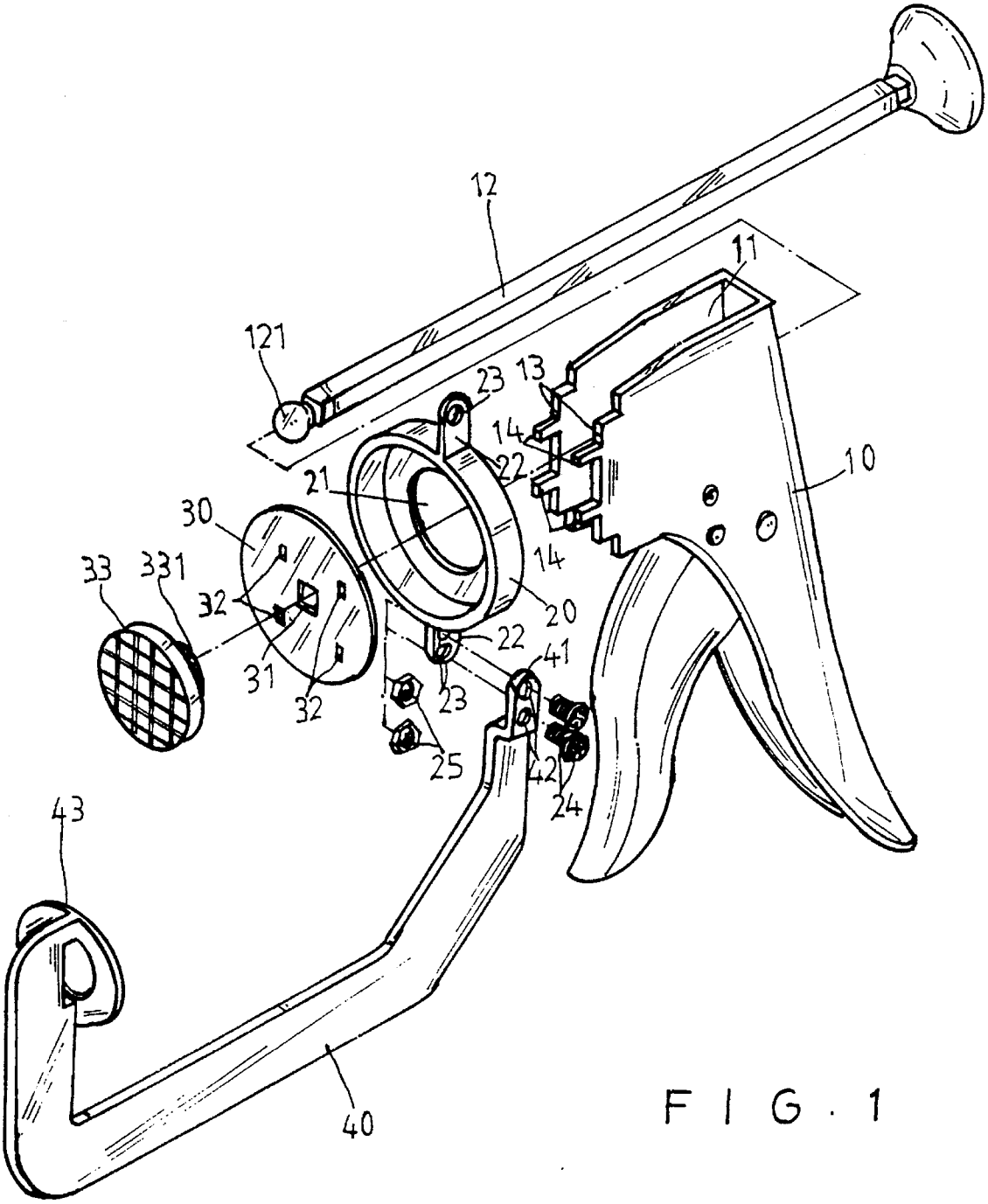
FIG. 1 is a perspective exploded view of a preferred embodiment in accordance with the invention.
Figure 2:
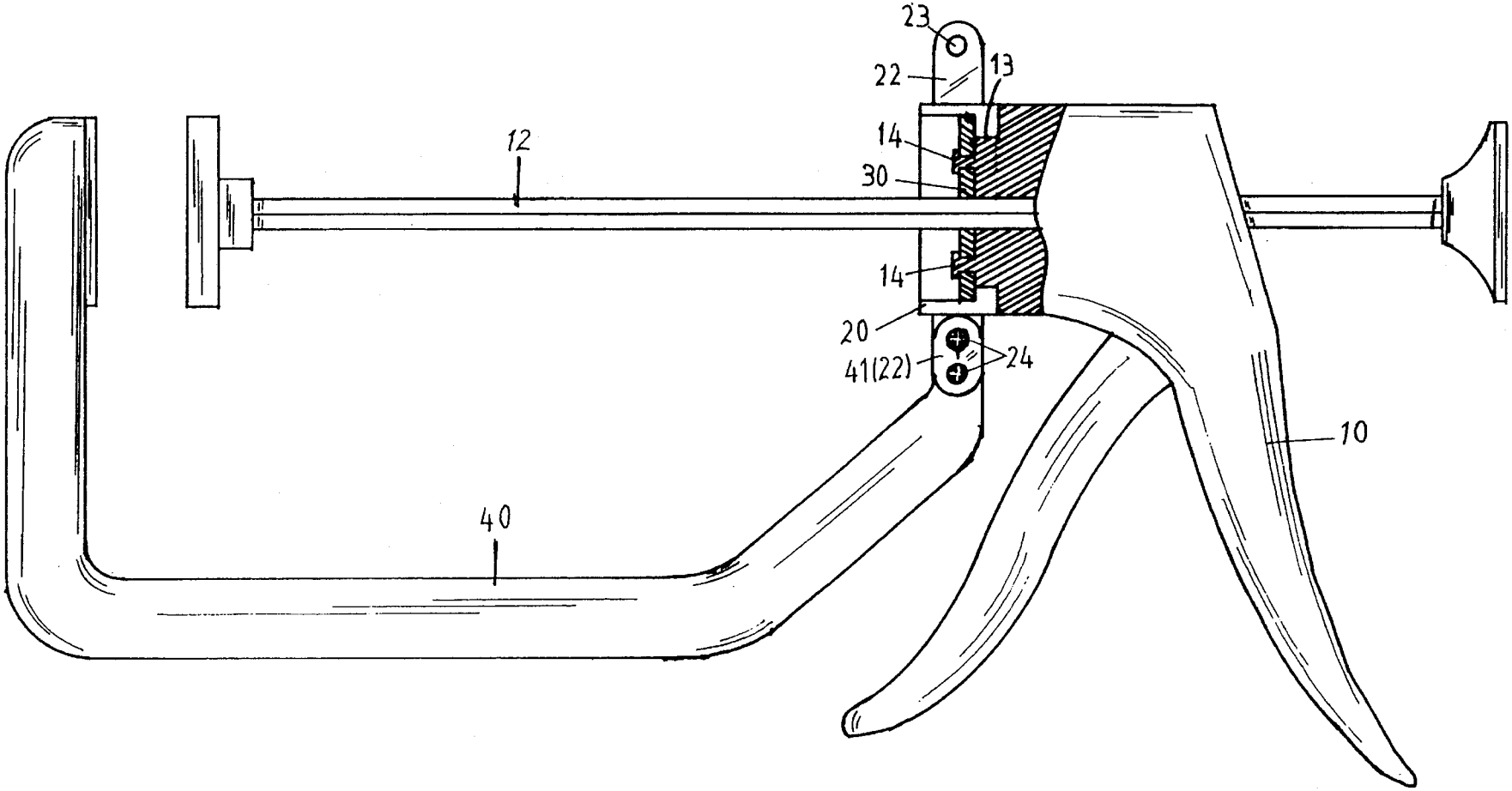
FIG. 2 is a partly cross-sectional, assembly view of FIG. 1.

Referring to FIGS. 1 and 2, an angle-adjustable C-clamp has a handle 10 with an upper interior 11 to receive a rod 12 which is controlled by a conventional driving mechanism. The upper front edge of the handle 10 has a couple of step-shaped front edges 13 with two positioning posts 14 extending forward from each front edge 13. The positioning posts 14 are inserted in a rotary seat 20 and a disk plate 30. The rotary seat 20 has a central opening 21 to receive the positioning posts 14. An upper and lower seat lugs 22 are protruded upward and downward from the rotary seat 20, respectively. The upper seat lug 22 has a through hole 23 thereon. The lower seat lug 22 has two through holes 23 thereon. The disk plate 30 which has a central square hole 31 and four rectangular holes 32 corresponding to the four positioning posts 14 is disposed in the rotary seat 20. The generally C-shaped frame 40 has a lobe 41 at one end and a fixed jaw 43 at the other end. The circular holes 42 are formed on the lobe 41 to match the through holes 23 on the lower seat lug 22 which are inserted by two screws 24 and fixed by two nuts 25. The rod 12 has a ball 121 at the front end. The rod 12 passes through the hole on the upper rear portion of the handle 10, the central opening 21 and the square hole 31. The ball 121 is inserted in the socket 331 of the movable jaw 33.

Figure 3:
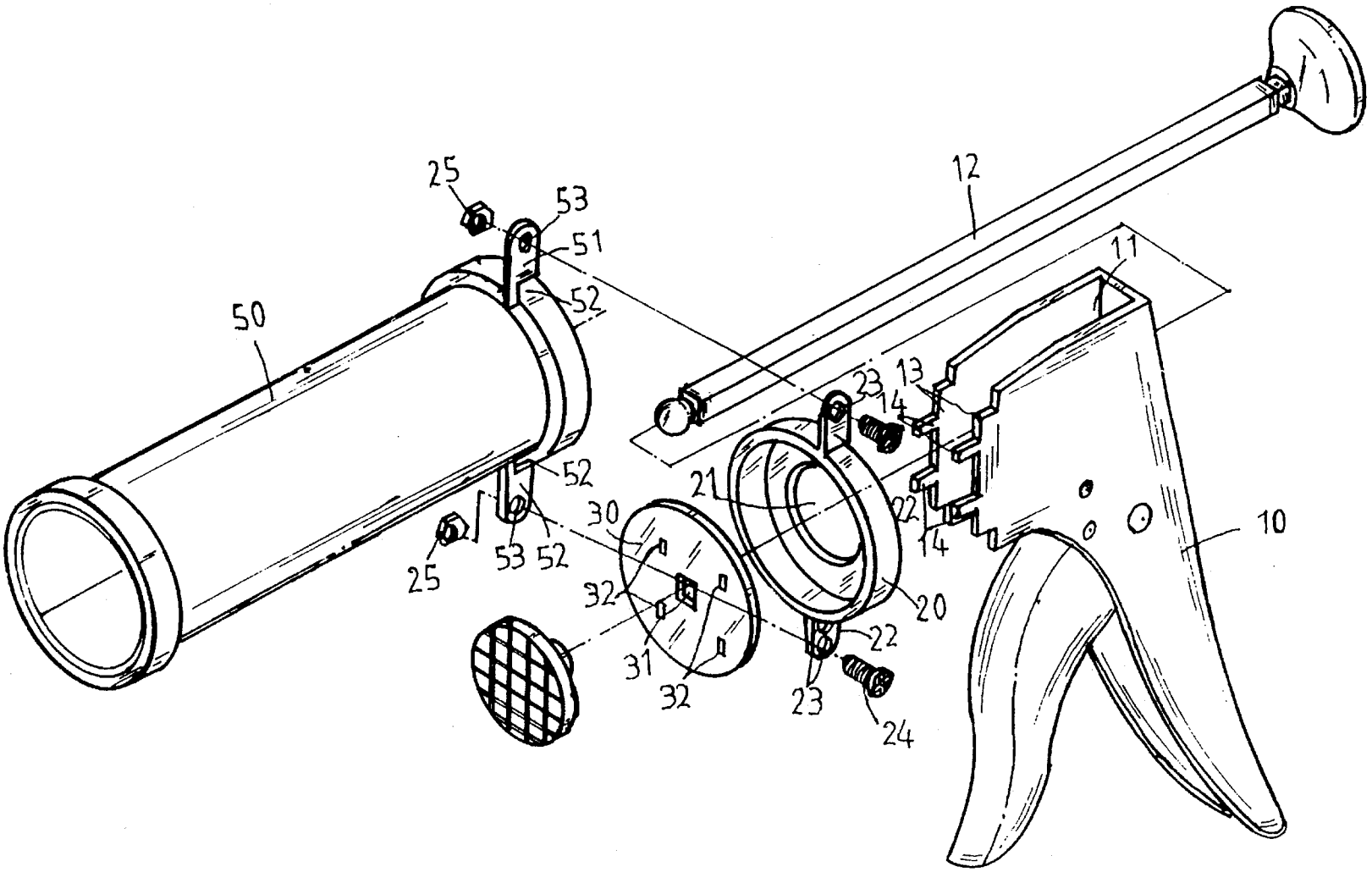
FIG. 3 is a perspective exploded view of another preferred embodiment in accordance with the invention.
Figure 4:
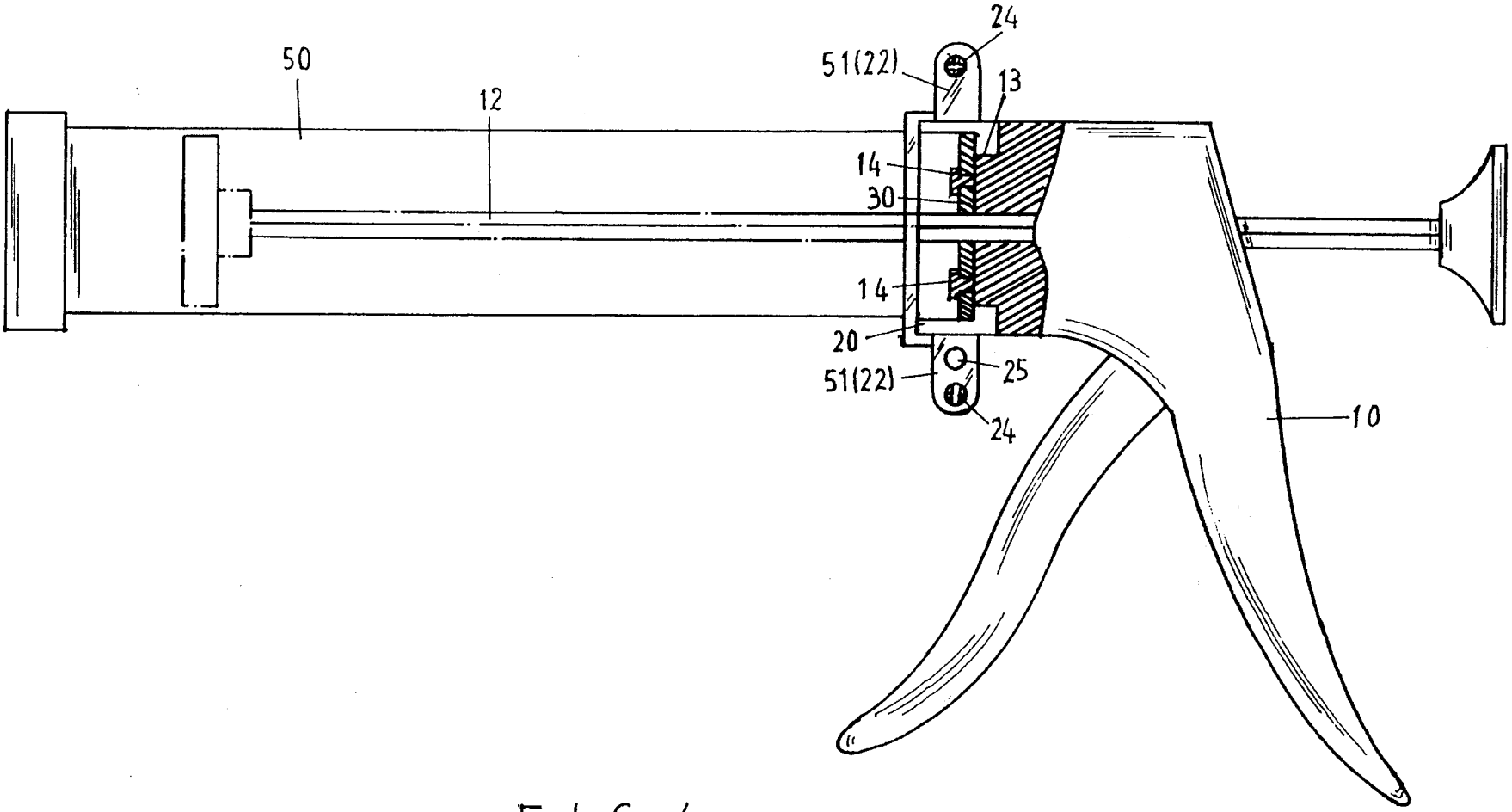
FIG. 4 is a partly cross-sectional, assembly view of FIG. 3.

Referring to FIGS. 3 and 4, a barrel 50 of a glue spreading gun can replaced the C-shaped frame. Two barrel lugs 51 are protruded upward and downward from the rear end rim of the barrel 50, respectively. Each barrel lug 51 has a round hole 53 to match the corresponding through hole 23 which are fixed by screws 24 and nuts 25. A recess 52 is formed between the rear end rim of the barrel 50 and the barrel lug 51 to receive the rotary seat 20.

Figure 6:
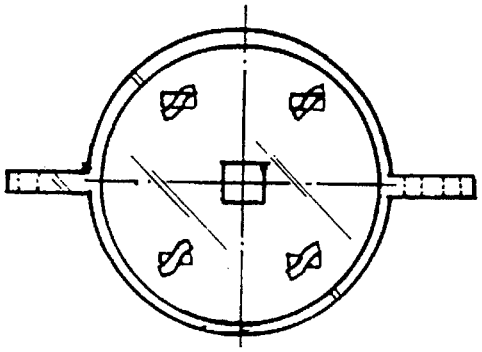
FIG. 6 is a plan view of a rotary seat.
Figure 7:
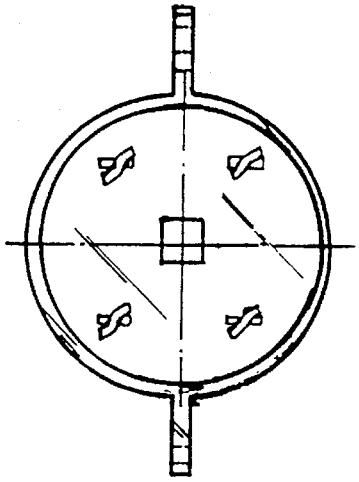
FIG. 7 is another plan view of a rotary seat.
Figure 5:
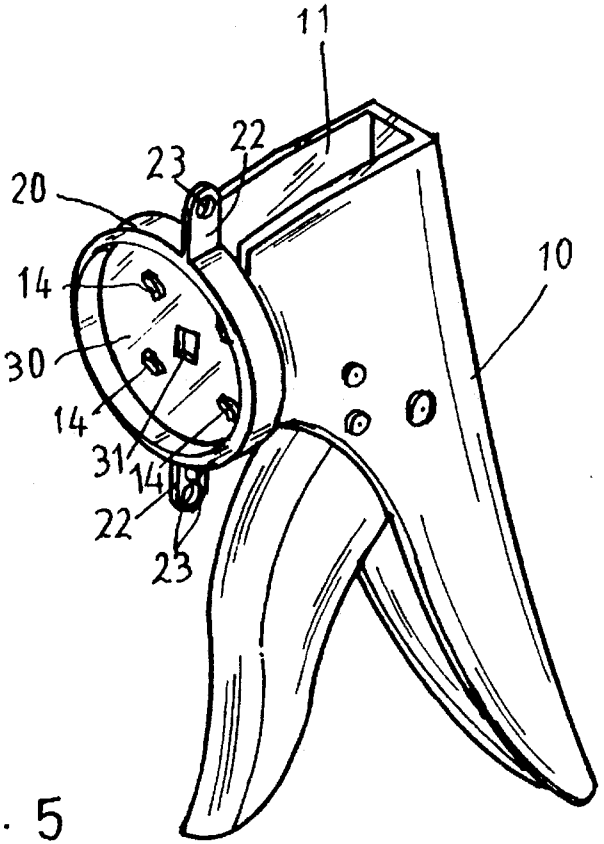
FIG. 5 is a perspective view of a rotary seat and a handle.

Referring to FIGS. 5, 6 and 7, the rotary seat 20 can be rotated at a predetermined angle. Thus the C-shaped frame or the barrel can be rotated with the rotary seat also.

The invention is not limited to the above embodiments but various modification thereof may be made. It will be understood by those skilled in the art that various changes in form and detail may be made without departing from the spirit and scope of the invention.

What is claimed is:

1. An angle-adjustable C-clamp comprising:

a handle with an upper interior to receive a rod;

an upper front edge of said handle having a couple of step-shaped front edges with two positioning posts extending forward from each of said step-shaped front edge;

said positioning posts inserted in a rotary seat and a disk plate;

said rotary seat having a central opening to receive said positioning posts;

an upper and lower seat lug protruded upward and downward from said rotary seat, respectively;

said disk plate which has a central square hole and four rectangular holes corresponding to said four positioning posts disposed in said rotary seat;

a generally C-shaped frame having a lobe at one end and a fixed jaw at the other end;

a rod having a ball at a front end to be inserted in a socket of a movable jaw; and said rod passing through said central opening and said square hole.

2. An angle-adjustable C-clamp comprising:

a handle with an upper interior to receive a rod;

an upper front edge of said handle having a couple of step-shaped front edges with two positioning posts extending forward from each of said step-shaped front edge;

said positioning posts inserted in a rotary seat and a disk plate;

said rotary seat having a central opening to receive said positioning posts;

an upper and lower seat lug protruded upward and downward from said rotary seat, respectively;

said disk plate which has a central square hole and four rectangular holes corresponding to said four positioning posts disposed in said rotary seat;

a rod having a ball at a front end to be inserted in a socket of a movable jaw;

said rod passing through said central opening and said square hole;

a barrel having two barrel lugs protruded upward and downward from a rear end rim of said barrel, respectively;

each of said barrel lugs having a round hole to match a corresponding through hole on said upper and lower seat lugs to be fixed by screws and nuts; and a recess formed between a rear end rim of said barrel and said barrel lug to receive said rotary seat.

* * * * *